US008903553B1

(12) United States Patent
Miyaji et al.

(10) Patent No.: US 8,903,553 B1
(45) Date of Patent: Dec. 2, 2014

(54) METHOD AND SYSTEM FOR CONTROLLING UNITARY AIR CONDITIONERS FOR REDUCING PEAK LOADS

(75) Inventors: Wendell Miyaji, Duluth, GA (US); John Rossi, Duluth, GA (US)

(73) Assignee: Comverge, Inc., Norcross, GA (US)

( * ) Notice: Subject to any disclaimer, the term of this patent is extended or adjusted under 35 U.S.C. 154(b) by 1329 days.

(21) Appl. No.: 12/433,938

(22) Filed: May 1, 2009

(51) Int. Cl.

| | |
|---|---|
| ***G01M 1/38*** | (2006.01) |
| ***G05B 13/00*** | (2006.01) |
| ***G05B 15/00*** | (2006.01) |
| ***G05D 23/00*** | (2006.01) |
| ***F25D 17/06*** | (2006.01) |
| ***F25D 17/00*** | (2006.01) |
| ***F25B 19/00*** | (2006.01) |
| ***F25D 23/12*** | (2006.01) |

(52) U.S. Cl.
USPC ..... 700/277; 700/276; 62/89; 62/231; 62/498; 62/428; 62/177; 62/178; 62/263; 236/51

(58) Field of Classification Search
USPC ..... 62/177–180, 263, 228.1; 700/276, 277; 236/51
See application file for complete search history.

(56) References Cited

U.S. PATENT DOCUMENTS

| | | | | |
|---|---|---|---|---|
| 3,352,352 | A | 11/1967 | Walters | |
| 4,187,543 | A | 2/1980 | Healey | |
| 4,289,272 | A * | 9/1981 | Murase et al. | 236/91 D |
| 4,370,863 | A * | 2/1983 | Fisher | 62/89 |
| 4,478,048 | A * | 10/1984 | Dills | 62/126 |
| 4,773,587 | A | 9/1988 | Lipman | |
| 4,784,212 | A | 11/1988 | Brimer | |
| 5,058,388 | A | 10/1991 | Shaw | |
| 5,372,015 | A | 12/1994 | Suzuki et al. | |
| 5,684,463 | A | 11/1997 | Diercks et al. | |
| 5,918,668 | A | 7/1999 | Trimble | |
| 6,427,454 | B1 | 8/2002 | West | |
| 6,681,154 | B2 | 1/2004 | Nierlich et al. | |
| 6,823,291 | B2 | 11/2004 | Marsland | |
| 6,945,058 | B2 * | 9/2005 | Bash et al. | 62/89 |
| 6,978,627 | B2 * | 12/2005 | Masui et al. | 62/127 |
| 7,163,158 | B2 * | 1/2007 | Rossi et al. | 236/51 |
| 7,379,997 | B2 | 5/2008 | Ehlers et al. | |
| 7,878,006 | B2 * | 2/2011 | Pham | 62/127 |
| 2002/0154026 | A1 * | 10/2002 | Niizato | 340/825.72 |
| 2003/0093332 | A1 | 5/2003 | Spool et al. | |

(Continued)

FOREIGN PATENT DOCUMENTS

| | | |
|---|---|---|
| EP | 2042816 A1 | 4/2009 |
| WO | 2008029201 | 3/2008 |
| WO | 2008064179 | 5/2008 |

*Primary Examiner* — Allen Flanigan
*Assistant Examiner* — Filip Zec
(74) *Attorney, Agent, or Firm* — Smith Risley; Steven P. Wigmore

(57) ABSTRACT

A method and system for controlling a unitary room air conditioner and for reducing peak loads can comprise a communications transceiver coupled to a relay or switch. This relay or switch can control the flow of electricity to a compressor of the air conditioner. The communications transceiver can receive signals which may direct the communications transceiver to open or close the relay or switch. In this way, the compressor can be controlled independent of the air conditioner's control logic. In other words, the operation of the compressor can be controlled with signals which originate outside of the unitary air conditioner and independent of the air conditioner's own internal control logic.

9 Claims, 2 Drawing Sheets

(56) References Cited

U.S. PATENT DOCUMENTS

| | | | | |
|---|---|---|---|---|
| 2004/0010347 | A1* | 1/2004 | Yamanashi et al. | 700/276 |
| 2004/0059815 | A1 | 3/2004 | Buckingham et al. | |
| 2004/0138981 | A1 | 7/2004 | Ehlers | |
| 2004/0139038 | A1 | 7/2004 | Ehlers | |
| 2006/0086112 | A1 | 4/2006 | Higgins | |
| 2006/0105697 | A1 | 5/2006 | Aronstam et al. | |
| 2006/0186214 | A1 | 8/2006 | Simon | |
| 2007/0129850 | A1 | 6/2007 | Miyaji et al. | |
| 2007/0132579 | A1 | 6/2007 | Kim | |
| 2007/0178823 | A1 | 8/2007 | Fincher | |
| 2007/0178825 | A1 | 8/2007 | Knobloch | |
| 2008/0017723 | A1 | 1/2008 | Johnson et al. | |
| 2008/0036878 | A1 | 2/2008 | Schmid et al. | |
| 2008/0048046 | A1 | 2/2008 | Wagner et al. | |
| 2008/0110187 | A1* | 5/2008 | Han et al. | 62/159 |
| 2008/0283621 | A1 | 11/2008 | Buckingham et al. | |
| 2010/0024455 | A1* | 2/2010 | Butorac et al. | 62/225 |

* cited by examiner

METHOD AND SYSTEM FOR CONTROLLING UNITARY AIR CONDITIONERS FOR REDUCING PEAK LOADS

FIELD OF INVENTION

The invention is generally directed to unitary or "room" air conditioners. The technology relates more particularly to controlling unitary air conditioners from a remote location.

BACKGROUND OF THE INVENTION

Unitary air conditioners, also known as room air conditioners, have all of the components of a central air conditioning system but all of the components are contained within a single housing. This means that the condenser, evaporator, expansion valve, compressor, exterior fan, and interior fan are generally contained within a single housing.

Unitary air conditioners are often used in buildings where there are multiple individual living spaces, such as in apartment buildings and office buildings. Within each living space, an occupant may have individual control over each respective unitary air conditioner that is supplied to cool a particular living space. In warm weather months or in warm weather climates, multiple unitary air conditioners operating at the same time can create tremendous loads on electric power grids.

Conventional approaches have suggested to power "on" unitary air conditioners in a staggered manner by completely eliminating power to a certain number of unitary air conditioners while allowing other unitary air conditioners to "run." While this approach of completely eliminating power to a select group of air conditioners is effective for reducing energy loads on electric power grids, this approach does create problems for the occupants who have the unitary air conditioners which are shut "off."

One problem is that when an unitary air conditioner is completely in an "off" state in which all mechanical components are not operational and not receiving any power, then air within the living space cooled by the unitary air conditioner does not circulate. When air does not circulate in a warm living space, an occupant may perceive the air to be stagnant and more hot than can be tolerated. Further, the occupant of the living space may be inclined to try and turn "on" a unitary air conditioner unit which has been placed in the "off" state to conserve power.

Accordingly, there is a need in the art for a method and system for controlling unitary air conditioners in a manner such that air within a living space is not permitted to become stagnant, while at the same time, reducing peak loads in order to prevent overloading of an electric grid.

SUMMARY OF THE INVENTION

A method and system for controlling a unitary room air conditioner and for reducing peak loads can comprise a communications transceiver coupled to a relay or switch. This relay or switch can control the flow of electricity to a compressor of the air conditioner. The communications transceiver can receive signals which may direct the communications transceiver to open or close the relay or switch. In this way, the compressor can be controlled independent of the air conditioner's control logic.

In other words, the operation of the compressor can be controlled with signals which originate outside of the unitary air conditioner and independent of the air conditioner's own internal control logic. With this system, the compressor can be turned off while an interior fan which circulates air within a room cooled by the unitary air conditioner can remain active or operational. This means that air within the room cooled by the air conditioner can be circulated even while the compressor is in an "off" state. When a plurality of unitary air conditioners are being controlled from a single location, then the powering of the compressors in each unitary air conditioner can be coordinated.

When the powering of the compressors in each unitary air conditioner is coordinated, then the compressors can be powered such that several compressors are never turned "on" or operational at the same time. This coordination of unitary air conditioners can reduce energy consumption during peak loads on a power grid.

DETAILED DESCRIPTION OF EXEMPLARY EMBODIMENTS

Figure 1:
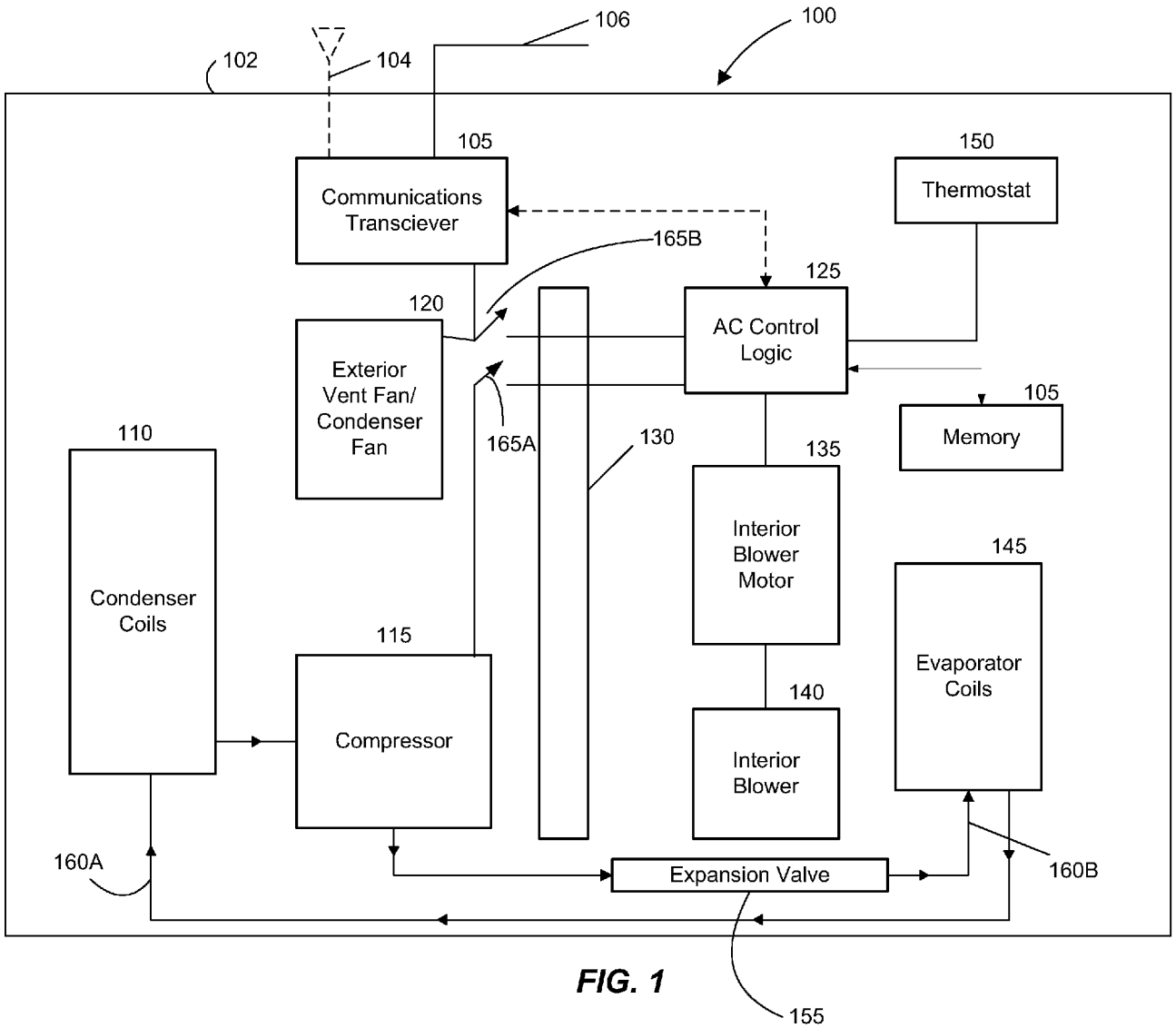
FIG. 1 is a functional block diagram of a unitary air conditioner according to one exemplary embodiment of the invention.

Turning now to the drawings, in which like reference numerals refer to like elements, FIG. 1 is a functional block diagram of a unitary air conditioner 100 according to one exemplary embodiment of the invention. The unitary air conditioner 100 can comprise a housing 102 that contains a communications transceiver 105 coupled to a relays or switches 165A, 165B. The relays or switches 165 may control power to a compressor 115 and the exterior vent fan/condenser fan 120.

The communications transceiver 105 may comprise a packet radio in which the transceiver 105 is coupled to an antenna 104. The communications transceiver 105 can support wireless communications protocols, such as the ZigBee wireless communication protocol. For the ZigBee wireless communication protocol, the transceiver 105 may comprise a low-powered digital radio which employs the IEEE802.15.4-2006 standard for wireless personal area networks (WPANs. However, other communication protocols and standards for radio frequency communications are not beyond the scope of the invention. For example, other communication protocols can include, but are not limited to IEEE802.11, Bluetooth IEEE802.16 (wireless LAN), Paging WAN, and other like wireless communication protocols.

In the alternative to a wireless embodiment, the transceiver 105 could also support power line communications (PLC. Plus referred to in this description include systems for carrying data on conductors 106 that may also be used for electric power transmission. Electrical power is typically transmitted over high voltage transmission lines, distributed over medium voltage, and used inside buildings at lower voltages. It is well understood to one of ordinary skill in the art that power line communications can be applied at each stage.

Many PLC technologies may limit themselves to one set of wires such as in the case of wires within a single structure, but some Plus can cross between two levels. For examples, some Plus can cross between a distribution network and premises wiring. The power line communications systems used herein may operate by impressing a modulated carrier signal on the wiring system 106. Different types of power line communications can use different frequency bands, depending on the signal transmission characteristics of the power wiring used.

Since many power wiring systems are usually intended for only transmission of alternating current power, many power wire circuits usually have a limited ability to carry higher frequencies. This propagation limitation can be a limiting factor for power line communications, however, this propagation problem is used advantageously by the unitary air conditioners 100 described herein.

Because of the attenuation of power line communications over relatively short distances, unitary air conditioners 100 of the same multi-unit building that are being serviced by the same, local distribution transformer 218 can form self-contain local area networks due to the propagation limitation noted above. This means that the strength of the signals for power line communications are such that usually only air conditioners 100 coupled to a distribution transformer or collocated in a building such as a high rise can communicate with one another. Air conditioners 100 coupled to a first transformer will likely not be able to detect or communicate with other air conditioners which are coupled to a second transformer due to the losses of RF power in the communication signals when they are propagated over power lines 203 for significant distances and through two or more transformers 218.

Specifically, there is typically high frequency loss through two or more transformers in a residential neighborhood system. Usually in such a system, a signal from a first residential building in a first neighborhood will not propagate to a second building in a second neighborhood because the signal would need to pass through two distribution transformers. In a network distribution of an urban environment, high frequency losses for communications signals can occur due to the amount and length of wires that exist between two different multiunit buildings.

The power line communication (PLC) systems can include Home Plug 1.0 which is a specification for home networking technology that couples devices to each other through power lines 106 in a building. Home Plug certified products may couple personal computers and other devices such as air conditioners 100 that may also use other communication standards such as Ethernet, USB (Universal Serial Bus) and wireless local area network communications such as IEEE 802.11. Many devices may have the Home Plug standard built in such as the air conditioners 100 illustrated in FIG. 1. With the Home Plug standard built-in into an air conditioner 100, to connect the air conditioner 100 to a network, all that is required is to plug the air conditioner 100 into an outlet of a wall in a home such that it may communicate with other devices that support the Home Plug standard.

Since the power line communication signals may travel a short distance outside of a home to a distribution transformer 218, like many other network standards, the Home Plug power line communication standard includes the ability to set an encryption password. As with many other networking products, most Home Plug devices are secured by default in which the standard may require that all devices supporting the standard are set to a default out-of-box password, which may be a common one. Users of the devices are encouraged to change this password for obvious reasons.

Devices which support the Home Plug power line communication standard may function as transparent network bridges which may allow computers running on any operating system to use them for network access. The Home Plug communication standard supports the ability to use Ethernet in a bus topology in which it has carrier sense, multiple access and collision detection.

This is achieved by the use of advanced orthogonal frequency division multiplexing (OFDM) that allows co-existence of several distinct data carriers along the same power-supplying wire. Use of OFDM allows turning off (masking) one or more of the subcarriers which overlap previously-allocated radio spectrum in a given geographical region. In North America, some Home Plug standards may only use 917 of an available 1,155 subcarriers.

Referring back again to FIG. 1, the switches or relays 165 of the unitary air conditioner 100 can comprise an electromagnetic relay (not illustrated). The relays 165 may comprise a coil of wire surrounding a soft iron core or an iron yoke, which provides a low reluctance path for magnetic flux, a moveable iron armature, and a set, or sets, of contacts. The armature may be hinged to the yoke and mechanically linked to a moving contact or contacts. It may be held in place by a spring so that when the relay is de-energized there is an air gap in the magnetic circuit. The relays 165 may have more or fewer sets of contacts depending on their function. The relays 165 may also have a wire connecting the armature to the yoke. This may ensure continuity of the circuit between the moving contacts on the armature, and the circuit track on a Printed Circuit Board (PCB) via the yoke, which may be coupled to a PCB, such as by a soldering.

When an electric current is passed through the coil of a relay 165, the resulting magnetic field attracts the armature, and the consequent movement of the movable contact or contacts either makes or breaks a connection with a fixed contact. If the set of contacts was closed when the relay 165 was de-energized, then the movement opens the contacts and breaks the connection, and vice versa if the contacts were open. When the current to the coil is switched off, the armature is returned by a force, approximately half as strong as the magnetic force, to its relaxed position. Usually this force is provided by a spring, but gravity may also be used.

Most relays 165 are manufactured to operate quickly. In a low voltage application, this speed may help to reduce noise. In a high voltage or high current application, this is to reduce arcing. The switches or relays 165 of the inventive system 100 may include, but is not limited to, those of a latching type, a reed type, a mercury-wetted type, a polarized type, a contactor type, a solid-state type, a solid-state contactor type, a buchholz type, and a forced-guided contacts type.

The relays 165 may be interposed between the compressor 115 and the NC control logic 125, and between the exterior vent fan/condenser fan 120 and NC control logic 125. The A/C control logic 125 can comprise any one of a combination of programmable circuitry. For example, the NC control logic 125 can comprise firmware in combination with a microcontroller, a microprocessor, a digital signal processor, or a state machine implemented in an application specific integrated circuit (ASIC), programmable logic, or other numerous forms of hardware and/or software without departing from the scope of the invention. The NC control logic 125 can be coupled to a memory device 105 and a thermostat 150.

The memory device 105 can comprise volatile or non-volatile memory. If the memory device 105 comprises volatile memory it can comprise RAM. If the memory device 105 comprises non-volatile memory, it can comprise ROMs or EEPROMS. Other hardware configurations for the memory device 105 are not beyond this scope of the invention.

The NC control logic 125 an also be coupled to an interior blower motor 135 which is coupled to an interior blower 140. The A/C control logic 125 can also be coupled an exterior vent fan 120 which may blow outside or external air over the condenser coils 110. Meanwhile, the interior blower or fan 140 is designed to recirculate air taken from the living space over the evaporator coils 145.

The evaporator coils 145 are coupled to an expansion valve 155 and condenser coils 110 through conduits 160A, 160B. The condenser coils 110 are coupled to the compressor 115 through another conduit. The compressor 115 is also coupled to the expansion valve 155 via conduit 160B.

As understood to one of ordinary skill in the art, during operation of the air conditioner 100, the compressor 115 compresses a refrigerant while it is in a liquid state. The refrigerant can comprise any one of hydrochlorofluorocarbons (HCFCs) and hydrofluorocarbons (HFCs) such as R-11, R-12, R-22, R-134A, and R-410A. The pressure on the refrigerant is allowed to drop when it passes through the expansion valve 155.

The refrigerant in a liquid state and at low pressure absorbs any heat from the living space and is transformed to vapor as it passes through the evaporator coils 145. The compressor 115 forces the vapor through the condenser coils 110 at which the vapor condenses to a liquid while also releasing the energy or heat that was absorbed at the evaporator stage of the cycle. The refrigerant then continues again through the compressor 115.

Within the housing 102, the exterior vent fan/condenser fan 120, the condenser coils 110, and compressor 115 can be separated from the interior blower motor 135, interior blower 140, and evaporator coils by an barrier or wall 130. The communications receiver 105, NC control logic 125, thermostat 150, and memory 105 can be placed on either side of the barrier or wall 130.

With the inventive air conditioner 100, a communications signal may be received by the communications transceiver 105 to activate the relays 165A, 165B which control power to the exterior vent fan/condenser fan 120 and the compressor 115. Meanwhile, the NC control logic 125 can still allow power to be supplied to the interior blower motor 135 and the interior blower 140. In this way, a substantial reduction in energy being consumed by the unitary air conditioner 100 while allowing the interior air to circulate, thus improving comfort compared to turning off the entire unitary air conditioner 100.

According to an alternate exemplary embodiment, the compressor 115 and exterior vent fan/condenser fan 120 may not be controlled directly by the communications transceiver 105. Instead, the communications transceiver 105 may be coupled directly to the NC control logic 125 as indicated with a dashed line. The NC control logic 125 could then control the relays 165 to turn power on and off for the fan 120 and compressor 115.

Figure 2:
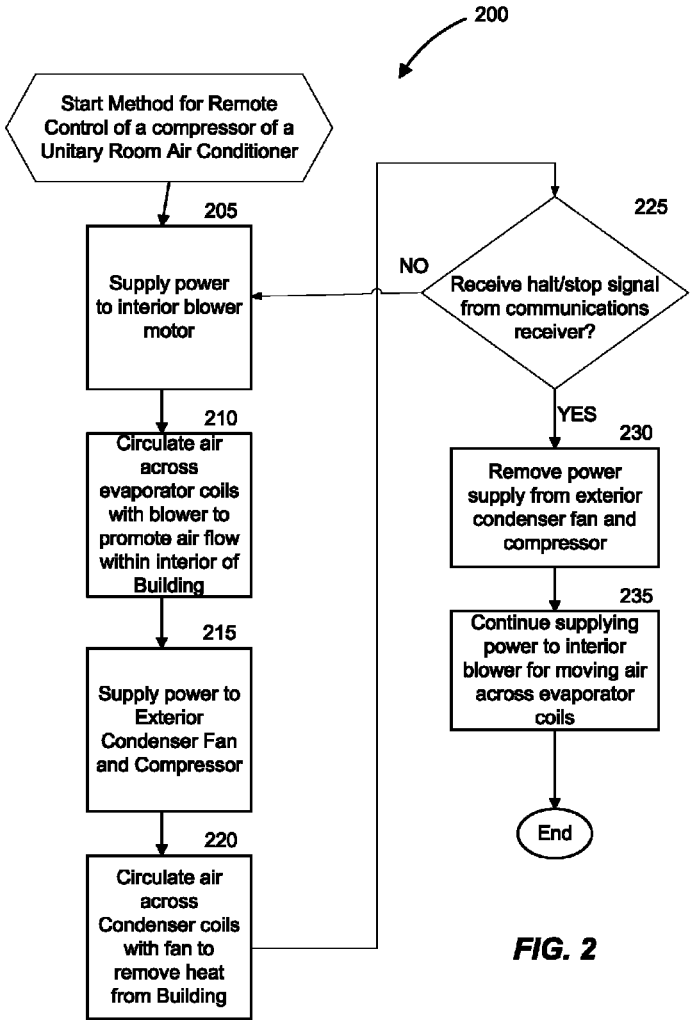
FIG. 2 is a logic flow diagram illustrating steps of an exemplary method for controlling a unitary air conditioner according to one exemplary embodiment of the invention.

Referring now to FIG. 2, this figure is a logic flow diagram illustrating steps of an exemplary method 200 for controlling a unitary air conditioner 100 according to one exemplary embodiment of the invention. This logic flow diagram of FIG. 2 highlights some key functional features of the unitary air conditioner of FIG. 1. As noted above, one of ordinary skill in the art will appreciate that the process functions of the unitary air conditioner 100 may comprise firmware code executing on a microcontroller, microprocessor, a DSP, or state machines implemented in application specific integrated circuits, or programmable logic, or other numerous forms without departing from the spirit and scope of the invention.

In other words, these steps illustrated in FIG. 2 and other logic flow diagrams of this disclosure maybe provided as a computer program which may include a machine-readable medium having stored there on instructions which may be used to program a computer (or other electronic devises) to perform a process according to the invention. The machine-readable medium may include, but is not limited, optical disk, CD-ROM, magneto-optical disks, ROMs, RAMs, EEPROMs, EEPROMs, magneto-optical cards, flash memory, or other type of medias/machine-readable mediums suitable for storing electronic instructions.

Certain steps in the processes or process flow described in all of the logic flow diagrams refer to in this specification must naturally precede others for the invention to function as described. However, the invention is not limited to the order of the steps described if such order or sequence does not alter the functionality of the present invention. That is, it is recognized that some steps may perform before, after, or parallel other steps without departing from the scope and spirit of the invention. Further, one of ordinary skill and programming would be able to write such a computer program or identify appropriate hardware at circuits to implement the disclosed invention without difficulty based on the flow charts and associated description in the application text, for example.

Therefore, disclosure of a particular set of program code instructions or detailed hardware devices is not considered necessary for an adequate understanding of how to make and use the invention. The inventive functionality of the claimed computer implemented processes would be explained in more detail in the following description and in conjunction with the remaining figures illustrating other process flows.

Step 205 is the first step of the process 200 in which power is supplied to the interior blower motor 135 to rotate the interior blower 140. Next, in step 210 air is circulated across the evaporator coils 145 with the blower 140 to promote air flow within an interior of a living space of a building. Subsequently, in step 215, power is supplied to the exterior condenser fan 120 and the compressor 115 in order to move refrigerant through the condenser coils 110 and the evaporator coils 145.

In step 220, air is circulated across the condenser coils 110 with the condenser fan 120. Next, in decision step 225, it is determined whether the communications receiver 105 has received a halt or stop signal. If the inquiry to decision step 225 is positive, then the "Yes" branch is followed to step 230. If the inquiry to decision step 225 is negative, then the "No" branch is followed back to step 205.

In step 230, power to the exterior condenser fan 120 or power to the compressor 230 (or both) can be removed. The removal of power can be accomplished with the communications receiver 105 instructing the relays 165A, 165B to be moved. Alternatively, the communications receiver 105 can communicate with the A/C control logic 125 which can control the relays 165A, 165B. In step 235, the NC control logic can continue supplying power to the interior blower motor 135 to move the blower 140 so that air is moved across the evaporator coils 145 even while the compressor 115 or the exterior fan 120 (or both) are "off" and non-operational.

Referring briefly back to FIG. 1, if the communications transceiver 105 is coupled to the AC control logic 125 as illustrated in FIG. 1 with dashed lines, information such as the interior temperature measured by the thermostat 150 can be passed to the communications transceiver 105. The communications transceiver 105 can then delay or suspend control by the A control logic 125 if the interior temperature is above an arbitrary temperature. Also, the communications transceiver 105 can send signals to the AC control logic 125 that mimic commands available at the AC front panel or via an optional remote control (not illustrated). Such a system would allow control of the unitary air conditioner 100 via the Internet.

Alternative embodiments of the unitary air conditioner 100 will become apparent to one of ordinary skill in the art to which the invention pertains without departing from its spirit and scope. Thus, although this invention has been described in exemplary form with a certain degree of particularity, it should be understood that the present disclosure is made only by way of example and that numerous changes in the details of construction and the combination and arrangement of parts or steps may be resorted to without departing from the scope or spirit of the invention. Accordingly, the scope of the present invention may be defined by the appended claims rather than the foregoing description.

What is claimed is:

1. A unitary air conditioner system comprising:

a central controller coupled to a plurality of unitary air conditioners via a communications network, the central controller issuing commands that coordinate powering of each unitary air conditioner;

the plurality of unitary air conditioners coupled to a communications network, each unitary air conditioner coupled to the communications network by a communications device, each communications device relaying the commands from the central controller for controlling power to a respective compressor of a respective unitary air conditioner, the commands from the central controller of a respective unitary air conditioner being coordinated with the plurality of unitary air conditioners by the central controller in order to reduce energy consumption during peak loads or reduce demand during a time period;

each unitary air conditioner comprising:

a housing comprising an interior wall that separates the housing into a first side facing an exterior of climate controlled space and second side facing an interior of the climate controlled space;

a communications device disposed within the housing and on the first side of the interior wall, the communications device comprising a programmable module that supports a communications protocol for sending and receiving messages over the communications network;

control logic disposed within the housing and coupled to the communications device, a first switching device, and a second switching device, the control logic processing the commands received from the central controller via the communications device;

a memory coupled to the control logic and on the first side of the interior wall;

a compressor disposed within the housing and on the second side of the interior wall;

an evaporator disposed within the housing and on the first side of the interior wall and coupled to the compressor;

the first switching device coupled between the compressor and a power supply, for interrupting power to the compressor in response to commands received from the control logic;

a first fan disposed within the housing and on the first side of the interior wall and for circulating air across the evaporator; the fan being coupled to the power supply and circulating air across the evaporator even when the first switching device is interrupting power to the compressor;

a condenser disposed within the housing and on the second side of the interior wall and coupled to the compressor;

a second fan disposed within the housing and on the second side of the interior wall and for circulating air across the condenser;

a second switching device coupled between the second fan and a power supply, for interrupting power to the second fan in response to commands received from the control logic.

2. The system of claim 1, wherein the communications device comprises a wireless communication device.

3. The system of claim 2, wherein the wireless communication device comprises a radio frequency transceiver.

4. The system of claim 1, wherein the communications device comprises a power line communications (PLC) module.

5. The system of claim 1, wherein the switching devices comprise an electromechanical element.

6. The system of claim 1, further comprising a thermostat.

7. A method for cooling or circulating air within a living space while conserving power, comprising:

coupling a plurality of unitary air conditioners and a central controller to a communications network, each unitary air conditioner coupled to the communications network by a communications device;

relaying switching device signals from the central controller for controlling power to a respective compressor of a respective unitary air conditioner using a respective first switching device coupled to the compressor and a second switching device coupled to a condenser fan;

coordinating the switching device signals of a respective unitary air conditioner with the plurality of unitary air conditioners by using the central controller in order to reduce energy consumption during peak loads or reduce demand during a time period;

the method at each unitary air conditioner of the plurality of unitary air conditioners comprising:

supplying power to an interior blower motor of a unitary air conditioner;

circulating air across an evaporator to promote air flow within a living space;

circulating air across a condenser with the condenser fan to remove heat from the living space;

controlling power to a condenser fan and a compressor with switching devices, control logic, and a communication device, the communications device coupled to the control logic and comprising a programmable module that supports a communications protocol for sending and receiving messages over the communications network, messages received from the communications device comprising switching device signals from the central controller;

relaying the switching device signals from the communications device and control logic to the switching devices for causing the switching devices to interrupt power to the condenser fan and compressor; and supplying power to an interior blower for moving air across evaporator coils irrespective of a state of the switching devices, each unitary conditioner comprising a housing having an interior wall that separates the housing into a first side facing an exterior of climate controlled space and second side facing an interior of the climate controlled space; the communications device disposed within the housing and on the first side of the interior wall, the communications device comprising a programmable module that supports a communications protocol for sending and receiving messages over the communications network that include the switching device signals.

8. The method of claim 7, wherein the communications network comprises the Internet.

9. The method of claim 8, wherein the communications device of each air conditioner comprises a wireless communications device.

* * * * *